US008663456B2

(12) United States Patent
Bridges et al.

(10) Patent No.: US 8,663,456 B2
(45) **Date of Patent: *Mar. 4, 2014**

(54) PROCESS FOR CRACKING HEAVY HYDROCARBON FEED

(75) Inventors: Robert S. Bridges, Friendswood, TX (US); Sellamuthu G. Chellappan, Houston, TX (US)

(73) Assignee: Equistar Chemicals, LP, Houston, TX (US)

( * ) Notice: Subject to any disclaimer, the term of this patent is extended or adjusted under 35 U.S.C. 154(b) by 535 days.

This patent is subject to a terminal disclaimer.

(21) Appl. No.: 12/952,662

(22) Filed: Nov. 23, 2010

(65) Prior Publication Data

US 2012/0125811 A1 May 24, 2012

(51) Int. Cl.
*C10G 69/06* (2006.01)
*C10G 55/04* (2006.01)
*C10G 9/36* (2006.01)

(52) U.S. Cl.
USPC ..... 208/50; 208/78; 208/130; 585/652

(58) Field of Classification Search
USPC ..... 208/49, 50, 51, 52 R, 53, 78, 79, 80, 84, 208/130, 131, 67; 585/652
See application file for complete search history.

(56) References Cited

U.S. PATENT DOCUMENTS 3,487,006 A 12/1969 Newman et al.
3,549,515 A 12/1970 Brainard et al.
3,617,493 A 11/1971 Wirth et al.
3,617,495 A * 11/1971 Zimmerman et al. ..... 208/80
3,839,484 A * 10/1974 Zimmerman et al. ..... 585/315
3,862,898 A 1/1975 Boyd et al.
3,898,299 A 8/1975 Jones
4,302,323 A * 11/1981 Chen ..... 208/89
4,310,439 A 1/1982 Langer
4,615,795 A * 10/1986 Woebcke et al. ..... 208/72
4,661,241 A * 4/1987 Dabkowski et al. ..... 208/131
4,923,594 A 5/1990 Pellet et al.
5,190,634 A * 3/1993 Fernandez-Baujin et al. ..... 208/107
5,506,365 A 4/1996 Mauleon et al.

(Continued)

OTHER PUBLICATIONS

Mohan S. Rana, Vicente Samano, Jorge Ancheyta, J.A.I. Diaz, A review of recent advances on process technologies for upgrading of heavy oils and residua, Jun. 2007, Fuel, vol. 86, Issue 9, pp. 1216-1231.*

(Continued)

*Primary Examiner* — Nina Bhat
*Assistant Examiner* — Jonathan Miller

(57) ABSTRACT

A hydrocarbon feed is passed to a first zone of a vaporization unit to separate a first vapor stream and a first liquid stream. The first liquid stream is passed to a second zone of the vaporization unit and contacted intimately with a countercurrent steam produce a second vapor stream and a second liquid stream. The first vapor stream and the second vapor stream are cracked in the radiant section of the steam cracker to produce a cracked effluent. The second liquid stream is thermally cracked in a coking drum to produce a coker effluent and coke. The coker effluent is separated into a coker gas and a coker liquid. The coker liquid is reacted with hydrogen in the presence of a catalyst to produce a hydroprocessed product. The hydroprocessed product is separated into a gas product and a liquid product. The liquid product is fed to the vaporization unit.

11 Claims, 1 Drawing Sheet

(56) References Cited

U.S. PATENT DOCUMENTS

| | | | | |
|---|---|---|---|---|
| 5,580,443 | A * | 12/1996 | Yoshida et al. | 208/130 |
| 6,179,995 | B1 | 1/2001 | Cash et al. | |
| 6,656,346 | B2 | 12/2003 | Ino et al. | |
| 6,936,230 | B2 | 8/2005 | Zhurin et al. | |
| 7,045,669 | B2 * | 5/2006 | Sumner et al. | 585/259 |
| 7,135,602 | B1 | 11/2006 | Le Van Mao | |
| 7,138,047 | B2 | 11/2006 | Stell et al. | |
| 7,374,664 | B2 | 5/2008 | Powers | |
| 7,404,889 | B1 | 7/2008 | Powers | |
| 7,550,642 | B2 | 6/2009 | Powers | |
| 7,560,019 | B2 * | 7/2009 | McCoy et al. | 208/106 |
| 7,563,357 | B2 * | 7/2009 | Keusenkothen et al. | 208/14 |
| 2001/0042702 | A1 | 11/2001 | Stuntz et al. | |
| 2004/0122274 | A1 * | 6/2004 | Van Egmond et al. | 585/639 |
| 2005/0010075 | A1 | 1/2005 | Powers | |
| 2005/0150817 | A1 | 7/2005 | Tallman et al. | |
| 2007/0090018 | A1 | 4/2007 | Keusenkothen et al. | |
| 2007/0090019 | A1 * | 4/2007 | Keusenkothen et al. | 208/106 |
| 2007/0232845 | A1 | 10/2007 | Baumgartner et al. | |
| 2008/0116109 | A1 | 5/2008 | McCoy et al. | |
| 2008/0223754 | A1 * | 9/2008 | Subramanian et al. | 208/86 |
| 2009/0050523 | A1 | 2/2009 | Halsey | |
| 2010/0314287 | A1 * | 12/2010 | Niu et al. | 208/57 |
| 2011/0042269 | A1 * | 2/2011 | Kuechler et al. | 208/57 |
| 2011/0062054 | A1 * | 3/2011 | Gao et al. | 208/57 |

OTHER PUBLICATIONS

James G. Speight, New Approaches to Hydroprocessing, Sep. 15, 2004, Catalysis Today, vol. 98, pp. 55-60.*

PCT International Search Report and Written Opinion, dated Jan. 25, 2012, corresponding to PCT Serial No. PCT/US/2011/061654.

PCT Search Report and Written Opinion for PCT/US2011/061418 mailed Jan. 23, 2012.

PCT Search Report and Written Opinion for PCT/US2011/061654 mailed Jan. 25, 2012.

PCT Search Report and Written Opinion for PCT/US2011/061992 mailed Jan. 24, 2012.

PCT Search Report and Written Opinion for PCT/US2011/065771 mailed Dec. 21, 2012.

B. E. Reynolds, E. C. Brown, M. A. Silverman, Clean Gasoline via VRDS/RFCC, Apr. 1992, Hydrocarbon Processing, vol. 71, Issue 4, pp. 43-52.

Richard H. McCue, Catalytic Olefins Production, American Institute of Chemical Engineers, 2003 Spring National Meeting, New Orleans, LA, Mar. 21, 2003, pp. 3-15.

Dilip Dharia et al., Chapter 8: Catalytic Cracking for Integration of Refinery and Steam Crackers, Nov. 2010, Advances in Fluid Catalytic Cracking, pp. 119-126.

* cited by examiner

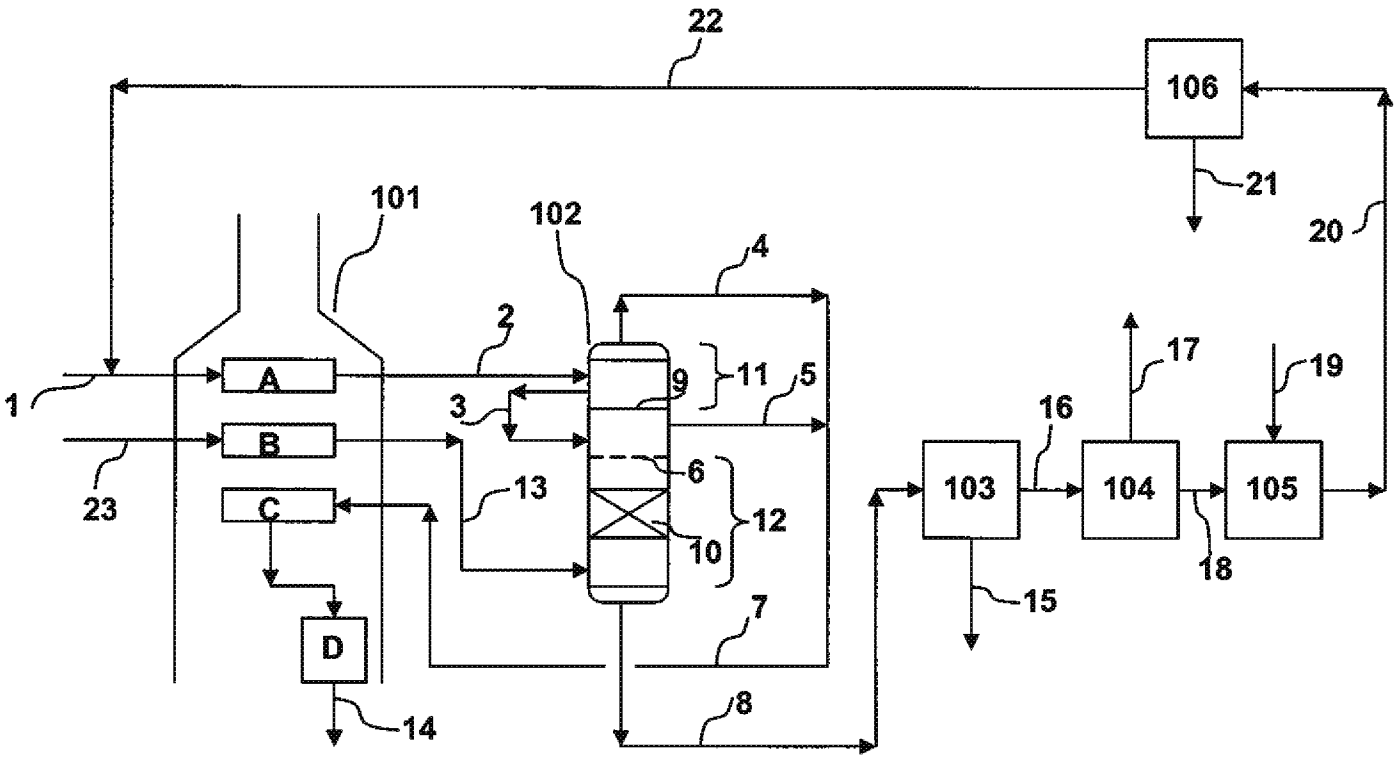
1
2
3
4
5
6
7
8
9
10
11
12
13
14
15
16
17
18
19
20
21
22
23
101
102
103
104
105
106
A
B
C
D

PROCESS FOR CRACKING HEAVY HYDROCARBON FEED

FIELD OF THE INVENTION

This invention relates to the production of olefins and other products by steam cracking of a heavy hydrocarbon feed.

BACKGROUND OF THE INVENTION

Steam cracking of hydrocarbons is a non-catalytic petrochemical process that is widely used to produce olefins such as ethylene, propylene, butenes, butadiene, and aromatics such as benzene, toluene, and xylenes. Typically, a mixture of a hydrocarbon feed such as ethane, propane, naphtha, gas oil, or other hydrocarbon fractions and steam is cracked in a steam cracker. Steam dilutes the hydrocarbon feed and reduces coking. Steam cracker is also called pyrolysis furnace, cracking furnace, cracker, or cracking heater. A steam cracker has a convection section and a radiant section. Preheating is accomplished in the convection section, while cracking reaction occurs in the radiant section. A mixture of steam and the hydrocarbon feed is typically preheated in convection tubes (coils) to a temperature of from about 900 to about 1,000 F (about 482 to about 538° C.) in the convection section, and then passed to radiant tubes located in the radiant section. In the radiant section, hydrocarbons and the steam are quickly heated to a hydrocarbon cracking temperature in the range of from about 1,450 to about 1,550 F (about 788 to about 843° C.). Typically the cracking reaction occurs at a pressure in the range of from about 10 to about 30 psig. Steam cracking is accomplished without the aid of any catalyst.

After cracking in the radiant section, the effluent from the steam cracker contains gaseous hydrocarbons of great variety, e.g., from one to thirty-five carbon atoms per molecule. These gaseous hydrocarbons can be saturated, monounsaturated, and polyunsaturated, and can be aliphatic, alicyclics, or aromatic. The cracked effluent also contains significant amount of molecular hydrogen. The cracked effluent is generally further processed to produce various products such as hydrogen, ethylene, propylene, mixed $C_4$ hydrocarbons, pyrolysis gasoline, and pyrolysis fuel oil.

Conventional steam cracking systems have been effective for cracking gas feeds (e.g., ethane, propane) or high-quality liquid feeds that contain mostly light volatile hydrocarbons (e.g., gas oil, naphtha). Hydrocarbon feeds containing heavy components such as crude oil or atmospheric resid cannot be cracked using a pyrolysis furnace economically, because such feeds contain high molecular weight, non-volatile, heavy components, which tend to form coke too quickly in the convection section of the pyrolysis furnace.

Efforts have been directed to develop processes to use hydrocarbon feeds containing heavy components in steam crackers due to their availability and lower costs as compared to high-quality liquid feeds. For example, U.S. Pat. No. 3,617,493 discloses an external vaporization drum for crude oil feed and a first flash to remove naphtha as a vapor and a second flash to remove volatiles with a boiling point between 450 to 1100 F (232 to 593° C.). The vapors are cracked in a pyrolysis furnace into olefins and the separated liquids from the two flash tanks are removed, stripped with steam, and used as fuel.

U.S. Pat. No. 3,487,006 teaches a process for integrating crude fractionation facilities with the production of petrochemical products wherein light distillates are initially separated from a crude in a first fractionator. The light-distillate-free crude is mixed with steam and passed through the convection section of a pyrolysis heater and introduced into a gas oil tower. The gas oil overhead from the gas oil tower is introduced, without condensation, into the radiant heating section of the pyrolysis heater to effect the cracking thereof to desired petrochemical products. U.S. Pat. No. 3,487,006 also teaches that the residuum from the gas oil tower may be further treated, e.g., by coking, to produce lighter products.

U.S. Pat. No. 3,898,299 teaches a process for producing gaseous olefins from an atmospheric petroleum residue feedstock. The process comprises: (a) contacting the petroleum residue feedstock in a hydrogenation zone with a hydrogenation catalyst at a temperature in the range 50 to 500° C., a pressure in the range 50 to 5,000 psig, and a liquid hourly space velocity in the range 0.1 to 5.0 to effect hydrogenation of aromatic hydrocarbons; (b) separating from the resulting hydrogenated atmospheric petroleum residue feedstock a gaseous phase containing hydrogen and a liquid phase containing hydrocarbons; (c) recycling at least a portion of the gaseous phase containing hydrogen to the hydrogenation zone; (d) separating the liquid phase containing hydrocarbons into a distillate fraction having a boiling range below 650° C. and a residue fraction having a boiling range above that of the distillate fraction; (e) subjecting the distillate fraction in the presence of steam to thermal cracking in a pyrolysis zone under conditions effecting conversion of at least a portion of the liquid phase to gaseous olefins; and (f) recovering the normally gaseous olefins from the pyrolysis zone effluent.

U.S. Pat. No. 4,310,439 discloses a catalyst system for alpha-olefin type polymerizations.

U.S. Pat. No. 7,374,664 discloses a method for utilizing whole crude oil as a feedstock for the pyrolysis furnace of an olefin production plant. The feedstock is subjected to vaporization conditions until substantially vaporized with minimal mild cracking but leaving some remaining liquid from the feedstock, the vapors thus formed being subjected to severe cracking in the radiant section of the furnace, and the remaining liquid from the feedstock being mixed with at least one quenching oil to lower the temperature of the remaining liquid.

U.S. Pat. No. 7,404,889 discloses a method for thermally cracking a hydrocarbon feed wherein the feed is first processed in an atmospheric thermal distillation step to form a light gasoline, a naphtha fraction, a middle distillate fraction, and an atmospheric residuum. The mixture of the light gasoline and the residuum is vaporized at least in part in a vaporization step, and the vaporized product of the vaporization step is thermally cracked in the presence of steam. The naphtha fraction and middle distillate fraction are not cracked. Middle distillates typically include heating oil, jet fuel, diesel fuel, and kerosene.

U.S. Pat. No. 7,550,642 discloses a method for processing a liquid crude and/or natural gas condensate feed comprising subjecting the feed to a vaporization step to form a vaporous product and a liquid product, subjecting the vaporous product to thermal cracking, and subjecting the liquid product to crude oil refinery processing.

U.S. Pat. No. 7,138,047 teaches a process for cracking a heavy hydrocarbon feedstock containing non-volatile hydrocarbons, comprising: heating the heavy hydrocarbon feedstock, mixing the heavy hydrocarbon feedstock with a fluid and/or a primary dilution steam stream to form a mixture, flashing the mixture to form a vapor phase and a liquid phase, and varying the amount of the fluid and/or the primary dilution steam stream mixed with the heavy hydrocarbon feedstock in accordance with at least one selected operating parameter of the process, such as the temperature of the flash stream before entering the flash drum.

Processes taught by U.S. Pat. Nos. 7,404,889, 7,550,642, and 7,138,047 all have the disadvantage of generating a residual oil by-product, which has to be sold or processed elsewhere.

There remains a need to develop efficient processes that can utilize a heavy hydrocarbon feed such as a heavy crude oil to produce olefins and other petrochemical compounds with high yields (see, e.g., U.S. Publication No. 2012/0125812 filed on Nov. 23, 2010, and U.S. Publication No. 2012/0125811 filed on Nov. 23, 2010).

SUMMARY OF THE INVENTION

This invention is a process for cracking a heavy hydrocarbon feed comprising a vaporization step, a coking step, a hydroprocessing step, and a steam cracking step. The heavy hydrocarbon feed is passed to a first zone of a vaporization unit to separate a first vapor stream and a first liquid stream. The first liquid stream is passed to a second zone of the vaporization unit and intimately contacted with a countercurrent steam to produce a second vapor stream and a second liquid stream. The first vapor stream and the second vapor stream are cracked in the radiant section of the steam cracker to produce a cracked effluent. The second liquid stream is thermally cracked in a coking drum to produce a coker effluent and coke. The coker effluent is separated into a coker gas and a coker liquid. The coker liquid is reacted with hydrogen in the presence of a catalyst to produce a hydroprocessed product. The hydroprocessed product is separated into a gas product and a liquid product. The liquid product is fed to the vaporization unit.

BRIEF DESCRIPTION OF THE DRAWING

FIG. 1 is a process flow diagram of one embodiment of the invention.

DETAILED DESCRIPTION OF THE INVENTION

The invention is a process for steam cracking a heavy hydrocarbon feed to produce ethylene, propylene, $C_4$ olefins, pyrolysis gasoline, and other products.

The heavy hydrocarbon feed may comprises one or more of gas oils, heating oils, jet fuels, diesels, kerosenes, gasolines, synthetic naphthas, raffinate reformates, Fischer-Tropsch liquids, Fischer-Tropsch gases, natural gasolines, distillates, virgin naphthas, crude oils, natural gas condensates, atmospheric pipestill bottoms, vacuum pipestill streams including bottoms, wide boiling range naphtha to gas oil condensates, heavy non-virgin hydrocarbon streams from refineries, vacuum gas oils, heavy gas oils, atmospheric residuum, hydrocracker wax, Fischer-Tropsch wax, and the like. One preferred heavy hydrocarbon feed is a crude oil.

The heavy hydrocarbon feed comprises hydrocarbons with boiling points of at least 565° C. ("heavy hydrocarbons"). The amount of heavy hydrocarbons in the feed is generally at least 1 wt %, preferably at least 10 wt %, most preferably at least 30 wt %.

The terms "hydrocarbon" or "hydrocarbonaceous" refers to materials that are primarily composed of hydrogen and carbon atoms, but can contain other elements such as oxygen, sulfur, nitrogen, metals, inorganic salts, and the like.

The term "whole crude oil," "crude oil," "crude petroleum," or "crude" refers to a liquid oil suitable for distillation, but which has not undergone any distillation or fractionation. Crude oil generally contains significant amounts of hydrocarbons and other components that boil at or above 1,050 F (565° C.) and non-boiling components such as asphaltenes or tar. As such, it is difficult, if not impossible, to provide a boiling range for whole crude oil.

The term "naphtha" refers to a flammable hydrocarbon mixture having a boiling range between about 30° C. and about 232° C., which is obtained from a petroleum or coal tar distillation. Naphtha is generally a mixture of hydrocarbon molecules having between 5 and 12 carbon atoms.

The term "light naphtha" refers to a hydrocarbon fraction having a boiling range of between 30° C. and 90° C. It generally contains hydrocarbon molecules having between 5 to 6 carbon atoms.

The term "heavy naphtha" refers to a hydrocarbon fraction having a boiling range of between 90° C. and 232° C. It generally contains hydrocarbon molecules having between 6 to 12 carbons.

The term "Fischer-Tropsch process" or "Fischer-Tropsch synthesis" refers to a catalytic process for converting a mixture of carbon monoxide and hydrogen into hydrocarbons.

The term "atmospheric resid" or "atmospheric residue" refers to a distillation bottom obtained in an atmospheric distillation of a crude oil in a refinery. The atmospheric resid obtained from an atmospheric distillation is sometimes referred to as "long resid" or "long residue." To recover more distillate product, further distillation is carried out at a reduced pressure and high temperature, referred to as "vacuum distillation." The residue from a vacuum distillation is referred to as a "short resid" or "short residue."

Steam crackers typically have rectangular fireboxes with upright tubes located between radiant refractory walls. Steam cracking of hydrocarbons is accomplished in tubular reactors. The tubes are supported from their top. Firing of the radiant section is accomplished with wall or floor mounted burners or a combination of both using gaseous or combined gaseous/liquid fuels. Fireboxes are typically under slight negative pressure, most often with upward flow of flue gas. The flue gas flows into the convection section by natural draft and/or induced draft fans. Usually two cracking furnaces share a common stack, and the height of the heater may vary from 30 to 50 meters. Radiant tubes are usually hung in a single plane down the center of the fire box. They can be nested in a single plane or placed parallel in a staggered, double-row tube arrangement. Heat transfer from the burners to the radiant tubes occurs largely by radiation, hence the term "radiant section," where the hydrocarbons are heated to a temperature of about 1,400 F to about 1,550 F (about 760 to 843° C.). Several engineering contractors including ABB Lummus Global, Stone and Webster, Kellogg-Braun & Root, Linde, and KTI offer cracking furnace technologies.

The cracked effluent leaving the radiant section is rapidly cooled to prevent reaction of lighter molecules into heavier compounds. A large amount of heat is recovered in the form of high pressure steam, which can be used in the olefin plant or elsewhere. The heat recovery is often accomplished by the use of transfer line exchangers (TLE) that are known in the art. The cooled effluent is separated into desired products, in a recovery section of the olefin plant, by compression in conjunction with condensation and fractionation, including hydrogen, methane, ethylene, propylene, crude $C_4$ hydrocarbons, pyrolysis gasoline, and pyrolysis fuel oil. The term "pyrolysis gasoline" refers to a fraction having a boiling range of from about 100 F to about 400 F (38 to 204° C.). The term "pyrolysis fuel oil" refers to a fraction having a boiling range of from about 400 F (204° C.) to the end point, e.g., greater than 1200 F (649° C.)

Coke is produced as a byproduct that deposits on the radiant tube interior walls, and less often in the convection tube interior walls when a gas feed or a high-quality liquid feed that contain mostly light volatile hydrocarbons is used. The coke deposited on the reactor tube walls limits the heat transfer to the tubes, increases the pressure drop across the coil, and affects the selectivity of the cracking reaction. The term "coke" refers to any high molecular weight carbonaceous solid, and includes compounds formed from the condensation of polynuclear aromatics. Periodically, the cracker has to be shut down and cleaned, which is called decoking. Typical run lengths are 25 to 100 days between decokings. Coke also deposits in transfer line exchangers.

Conventional steam crackers are effective for cracking high-quality liquid feeds, such as gas oil and naphtha. Heavy hydrocarbon feeds cannot be economically cracked using a conventional steam cracker because they tend to form coke in the convection tubes and the radiant tubes more readily, which reduces the run-length of the cracker.

The process of this invention comprises directing the heavy hydrocarbon feed to a first zone of a vaporization unit and separating a first vapor stream and a first liquid stream. The vaporization unit has two zones: a first zone and a second zone. In the first zone, gas-liquid separation occurs to form a first vapor stream and a first liquid stream. The first vapor stream exits the first zone and enters the radiant section of the steam cracker.

The heavy hydrocarbon feed may be preheated in the convection zone of the steam cracker to a temperature of 350 to 400 F (177 to 204° C.) at about 15 to 100 psig before it enters the vaporization unit. Steam may be added to the heavy hydrocarbon feed before it enters the vaporization unit. Generally the first zone is maintained at a temperature of from about 350 to about 400 F (177 to 204° C.) and a pressure of 15 to 100 psig.

The first liquid stream enters the second zone of the vaporization unit. Generally the second zone is located below the first zone. In the second zone, the first liquid is contacted with steam in a countercurrent fashion so that at least a portion of hydrocarbon components are vaporized. The steam, preferably at a temperature of from about 900 to about 1300 F (482 to 704° C.) enters the second zone and provides additional thermal energy to the liquid hydrocarbons in the second zone which promotes further vaporization of the liquid hydrocarbons. The vaporous hydrocarbons formed in the second zone (the second vapor stream) exits the vaporization unit and enter the radiant section of the steam cracker. The remaining liquid hydrocarbons (the second liquid stream) exit the second zone from the bottom of the vaporization unit. Typically, the second zone is operated at a temperature of from about 500 to about 900 F (260 to 482° C.) and a pressure of from about 15 to about 100 psig. The weight ratio of steam fed to the second zone to the first liquid stream entering the second zone may be in the range of about 0.3:1 to about 1:1.

The second liquid stream is thermally cracked to produce a coker effluent and coke. This step is called coking, or sometimes delayed coking. Coking is a process for thermally decomposing, under pressure, of large hydrocarbon molecules to form smaller molecules without the use of steam or catalyst. Coking is used to produce lighter, more valuable hydrocarbons from relatively low value feedstocks such as a heavy residuum. Coking is normally carried out at temperatures of from about 800 to about 1050 F (426 to 565° C.) and at a pressure of from about 15 to about 50 psig.

In addition to coke, the coking step produce a coker effluent, which is a mixture of distillable hydrocarbons of a wide range of molecular weights, including gases (typically including methane, ethane, ethylene, propane, propylene, butanes, butenes, hydrogen, carbon dioxide, hydrogen sulfide, and the like), naphtha, light gas oil, and a heavy gas oil. The heavy gas oil typically has a boiling range of about 650 to about 1,050 F (about 343 to about 565° C.). The coke obtained is usually used as fuel, but specialty uses, such as electrode manufacture and the production of chemicals and metallurgical coke, are also possible.

The coker effluent is separated into a coker gas and a coker liquid. Commonly this is done by cooling the coker effluent to a temperature of about 90 to about 120 F (32 to 49° C.) and under a pressure of about 10 to about 50 psig. The coker gas generally contains methane, ethane, ethylene, propane, propylene, hydrogen, carbon dioxide, hydrogen sulfide, and other hydrocarbons. Preferably, the coker gas is passed to the recovery section of the olefin plant for further purification.

The coker liquid is reacted with hydrogen in the presence of a catalyst to produce a hydroprocessed product. The term "hydroprocess" means to treat a hydrocarbon stream with hydrogen in the presence of a catalyst. Hydroprocessing includes hydrocracking and hydrotreating. The term "hydrocracking" generally refers to the breaking down of high molecular weight material into lower molecular weight material. To "hydrocrack" means to split an organic molecule with hydrogen to the resulting molecular fragments to form two or more smaller organic molecules.

The hydrocracking of the coker liquid may be conducted according to conventional methods known to a person skilled in the art. Typical hydrocracking conditions are described in, by way of example, U.S. Pat. No. 6,179,995, the contents of which are herein incorporated by reference in their entirety. Typically, hydrocracking is effected by contacting the coker liquid with hydrogen in the presence of a suitable hydrocracking catalyst at a temperature in the range of from about 600 to about 900 F (316 to 482° C.), preferably about 650 to about 850 F (343 to 454° C.), and at a pressure in the range of from about 200 to about 4000 psig, preferably about 500 to about 3000 psia, and at a space velocity of from about 0.1 to about 10 $h^{-1}$, preferably about 0.25 to about 5 $h^{-1}$. A suitable catalyst for hydrocracking generally comprises a cracking component, a hydrogenation component, and a binder. Hydrocracking catalysts are well known in the art. The cracking component may include an amorphous silica-alumina and/or a zeolite, such as a Y-type or USY zeolite. The binder is generally silica or alumina. The hydrogenation component can be a Group VI, Group VII, or Group VIII metal, preferably one or more of molybdenum, tungsten, cobalt, or nickel. If present in the catalyst, these hydrogenation components generally make up from about 5% to about 40% by weight of the catalyst. Alternatively, a platinum group metal, e.g., platinum or palladium, may be present as the hydrogenation component, either alone or in combination with the base metal hydrogenation components molybdenum, tungsten, cobalt, or nickel. If present, the platinum group metals generally make up from about 0.1% to about 2% by weight of the catalyst.

The term "hydrotreat" refers to the saturation of a carbon-carbon double bond (e.g., in an olefin or aromatics) or a carbon-carbon triple bond and removal of heteroatoms (e.g., oxygen, sulfur, nitrogen) from heteroatomic compounds. Typical hydrotreating conditions are well known to those skilled in the art and are described in, by way of example, U.S. Pat. No. 6,179,995, the contents of which are herein incorporated by reference in their entirety. Hydrotreating conditions include a reaction temperature of between about 400 F and about 900 F (204 and 482° C.), preferably about 650 F to about 850 F (343 to 454° C.); a pressure between about 500 and about 5000 psig (34 and 340 atm), preferably about 1000 to about 3000 psig (68 to 204 atm); and a liquid hourly space velocity (LHSV) of about 0.5 $h^{-1}$ to about 20 $h^{-1}$. A suitable hydrotreating catalyst comprises a Group VI metal and a Group VIII metal supported on a porous refractory carrier such as alumina. Examples of hydrotreating catalysts are alumina supported cobalt-molybdenum, nickel-tungsten, cobalt-tungsten and nickel-molybdenum. Typically the hydrotreating catalysts are presulfided.

A hydroprocessed product produced from hydrocracking and/or hydrotreating is separated into a gaseous hydroprocessed product and a liquid hydroprocessed product. The gas hydroprocessed product generally contains hydrogen, hydrogen sulfide, ammonia, water, methane, ethane, ethylene, propane, propylene, carbon dioxide, and other hydrocarbons. Preferably, the gaseous hydroprocessed product is passed to the recovery section of the olefin plant for further purification.

The liquid hydroprocessed product is fed to the vaporization unit. Depending on the temperature of the hydroprocessed product, it may be combined with the feed and further heated in the convection section of the cracker, or directly fed to the vaporization unit.

The liquid hydroprocessed product typically has a hydrogen content of from about 13 to 15 wt %, which is about 1 to about 3 wt % higher than that of the overhead product prior to the hydroprocessing treatment. The higher hydrogen content helps to improve the selectivity to lower olefins in the steam cracking, thus producing more ethylene and propylene and less fuel-grade chemicals. In addition, hydrocracking reduces the average molecular weight and reduces aromatic content, which reduces coking in the convection tubes and the radiant tubes. Hydrotreating reduces sulfur, nitrogen, and oxygen contents of the overhead hydrocarbon product. Hydrotreating can also saturate polynuclear aromatic hydrocarbons and therefore reduce coking.

The process produces a cracked effluent in the radiant section of the furnace, which is processed by techniques to produce products such as hydrogen, ethylene, propylene, pyrolysis gasoline, and pyrolysis fuel oil. It may be desirable to thermally crack the pyrolysis fuel oil in the same coking step to produce additional feed for steam cracking. For example, the pyrolysis fuel oil may be mixed with the second liquid stream from the vaporization unit to form a combined stream, which is thermally cracked in the coking step.

FIG. 1 is a process flow diagram of one embodiment of the invention. A crude oil feed 1 is passed through a preheat zone A of the convection section of furnace 101. The crude oil feed is then passed via line 2 to vaporization unit 102, which includes an upper zone (the first zone) 11 and a lower zone (the second zone) 12. Hydrocarbon vapors that are associated with the preheated feed as received by unit 102, and additional vapors formed in zone 11, are removed from zone 11 by way of line 4 as the first vapor stream.

The hydrocarbon liquid (the first liquid stream) that is not vaporized in zone 11 moves via line 3 to the upper interior of zone 12. Zones 11 and 12 are separated from fluid communication with one another by an impermeable wall 9, which, for example, can be a solid tray. Line 3 represents external fluid down-flow communication between zones 11 and 12. If desired, zones 11 and 12 may have internal fluid communication between them by modifying wall 9 to be at least in part liquid-permeable to allow for the liquid in zone 9 to pass down into the upper interior of zone 12 and the vapor in zone 12 to pass up into the lower interior of zone 11.

By whatever way the first liquid stream moves from zone 11 to zone 12, it moves downwardly into the upper interior of zone 12, and encounters preferably at least one liquid distribution device 6. Device 6 evenly distributes liquid across the transverse cross section of unit 102 so that the downwardly flowing liquid spreads uniformly across the width of the tower before it contacts bed 10. Suitable liquid distribution devices include perforated plates, trough distributors, dual flow trays, chimney trays, spray nozzles, and the like.

Bed 10 extends across the full transverse cross section of unit 102 with no large open vertical paths or conduits through which a liquid can flow unimpeded by bed 10. Thus, the downwardly flowing liquid cannot flow from the top to the bottom of the second zone 12 without having to pass through bed 10. Preferably, bed 10 contains packing materials and/or trays for promoting intimate mixing of liquid and vapor in the second zone.

Primary dilution steam, generated by preheating a low temperature steam in line 23 by zone B, is introduced into the lower portion of zone 12 below bed 10 via line 13. The first liquid stream from the first zone 11, enters the second zone 12 via line 3, passes liquid distributor 6, moves downwardly in zone 12, and intimately mixes with the steam in bed 10. As a result, additional vapor hydrocarbons (the second vapor stream) are formed in zone 12. The newly formed vapor, along with the dilution steam, is removed from zone 12 via line 5 and combined with the vapor in line 4 to form a hydrocarbon vapor stream in line 7. The stream in line 7 contains all hydrocarbon vapors (the first vapor stream and the second vapor stream) generated in the vaporization unit from feed 1 and steam fed to the vaporization unit.

The hydrocarbon vapors and steam from the vaporization unit is passed through a preheat zone C in the convection zone of furnace 101, further heated to a higher temperature, and enters the radiant tubes in the radiant section D of furnace 101. In the radiant section D, the vaporous hydrocarbons are cracked.

The remaining liquid hydrocarbons (the second liquid stream) in zone 12 exit vaporization unit 102 from the bottom, and is heated up (not shown in FIG. 1) and fed to a coking zone 103, where it is thermally cracked to form a coker effluent and coke. The coke is removed via line 15. The coker effluent is cooled and separated in zone 104 into a coker gas (typically containing methane, ethane, ethylene, propane, propylene, butanes, butenes, hydrogen, carbon dioxide, hydrogen sulfide, and the like) in line 17 and a coker liquid. The coker gas in line 17 is optionally passed to the recovery section of the olefin plant for purification.

The coker liquid enters the hydroprocessing zone 105 via line 18. Hydrogen is added to hydroprocessing zone 105 via line 19. The hydroprocessed product in line 20 is cooled in zone 106 and separated into a gaseous hydroprocessed product in line 21 and a liquid hydroprocessed product in line 22. The liquid hydroprocessed product is combined with feed 1. The gas hydroprocessed product in line 21 is optionally passed to the recovery section of the olefin plant for purification.

This invention efficiently separates a heavy hydrocarbon feed into vapor streams and the second liquid stream. The second liquid stream is further thermally cracked into smaller hydrocarbon molecules in a coking step. The hydroprocessing of the coker liquid further cracks the hydrocarbon molecules, removes sulfur, nitrogen, and oxygen from the coker liquid, and saturates the polynuclear aromatic molecules, thus produces additional feed for the steam cracking step. The coker gas and the gaseous hydroprocessed product can both be processed in the recovery section of the olefin plant. The process produces light olefins such as ethylene, propylene, and other useful petrochemical intermediates directly from a heavy hydrocarbon feed, such as a crude oil, without the need of a refinery-type operation.

Example

FIG. 1 illustrates a steam cracking process in an olefin plant according to this invention. A crude oil known as Arab Heavy crude is fed via line 1 to preheat zone A of the convection section of pyrolysis furnace 101 at a rate of 87,000 lb/h at ambient temperature and pressure. The Arab heavy crude contains about 31 wt % of hydrocarbons that boil at a temperature greater than 1,050 F (565° C.), including asphaltenes and tars. In the convection section, the feed is heated to about 740 F (393° C.) at about 60 psig, and then passed via line 2 into the upper zone 11 of vaporization unit 102. In zone 11, a mixture of gasoline and naphtha vapors are formed at about 350 F (177° C.) and 60 psig, which is separated from the remaining liquid. The separated vapors are removed from zone 11 via line 4.

The hydrocarbon liquid remaining in zone 11, is transferred to lower zone 12 via line 3 and fall downwardly in zone 12 toward the bottom of unit 102. Preheated steam at about 1,020 F (549° C.) is introduced to the bottom portion of zone 12 at a rate of 30,000 lb/h via line 13 to give a steam-to-hydrocarbon weight ratio of about 0.6:1 in section 12. The falling hydrocarbon liquid droplets in zone 12 are contacted with the rising steam through packing bed 10.

A gaseous mixture of steam and hydrocarbons at about 800 F (426° C.) is withdrawn from near the top of zone 12 via line 5 and mixed with the vapors removed from zone 11 via line 4 to form a combined steam-hydrocarbon vapor mixture in line 7. The mixture in line 7 has a steam-to-hydrocarbon weight ratio of about 0.5:1. This mixture is preheated in zone C, and introduced into zone D of the radiant section at a total flow rate of 90,000 lb/h for thermal cracking at a temperature in the range of 1,450 F to 1,550 F (788 to 843° C.). The cracked products are removed by way of line 14 for down-stream processing in the recovery section (not shown in FIG. 1) of the olefin plant.

The residual oil from zone 12 is removed from unit 102 at a rate of 27,000 lb/h at a temperature of about 600 F (315° C.) and a pressure of about 70 psig via line 8, heated to a temperature of about 900 F (482° C.), and passed to a coking drum 103, which is operated at a temperature of about 900 F (482° C.) and a pressure of about 60 psig. About 32% of the residual oil is converted to coke.

A coker effluent formed in the coking drum 103 is removed via line 16 at a rate of 18,500 lb/h. The coker effluent contains about 6.8 wt % gases, about 19.5 wt % naphtha, about 27.7 wt % light coker gas oil, and about 13.5 wt % heavy coker gas oil. The coker effluent is cooled to a temperature of about 120 F, and as a result separated into a coker gas and a coker liquid. The coker gas in line 17 is passed to the recovery section of the olefin plant. The coker liquid is hydroprocessed with hydrogen in zone 104 in the presence of a Ni—Mo catalyst. The hydroprocessing reaction is carried out at a temperature of about 500 to 600° F., a pressure of about 2000 psig, and a weight hourly space velocity of about 2 $h^{-1}$ to form a hydroprocessed product. The hydroprocessed product is cooled to a temperature of about 120 F in zone 106, where a gas product is separated from a liquid product. The liquid product is combined with feed 1 via line 21. The gas product is passed, via line 22, to the recovery section of the olefin plant for further purification.

We claim:

1. A process for cracking a heavy hydrocarbon feed in a steam cracker having a convection section and a radiant section, the process comprising:

(a) passing the heavy hydrocarbon feed to a first zone of a vaporization unit and separating the feed into a first vapor stream and a first liquid stream in the first zone;

(b) passing the first liquid stream to a second zone of the vaporization unit and contacting the first liquid stream with counter-current steam in the second zone of the vaporization unit so that the first liquid stream intimately mixes with the steam to produce a second vapor stream and a second liquid stream;

(c) steam-cracking the first vapor stream and the second vapor stream in the radiant section of the steam cracker to produce a cracked effluent;

(d) thermally cracking the second liquid stream to produce a coker effluent and coke;

(e) separating the coker effluent into a coker gas and a coker liquid;

(f) hydroprocessing the coker liquid to produce a hydroprocessed product;

(g) separating the hydroprocessed product into a gaseous hydroprocessed product and a liquid hydroprocessed product;

(h) passing the liquid hydroprocessed product to the vaporization unit.

2. The process of claim 1 wherein the heavy hydrocarbon feed comprises at least 1 wt % hydrocarbons with boiling points of at least 560° C.

3. The process of claim 1 wherein the heavy hydrocarbon feed comprises at least 10 wt % hydrocarbons with boiling points of at least 560° C.

4. The process of claim 1 wherein the heavy hydrocarbon feed is heated to 177 to 204° C. in the convection section of the steam cracker before it enters the first zone of the vaporization unit.

5. The process of claim 1 wherein the first zone of the vaporization unit is at a temperature of from 177 to 204° C. and a pressure of 15 to 100 psig.

6. The process of claim 1 wherein the counter-current steam is at a temperature of from 482 to 704° C. and a pressure of 15 to 100 psig.

7. The process of claim 1 wherein the second zone of the vaporization unit is at a temperature of from 260 to 482° C. and a pressure of 15 to 100 psig.

8. The process of claim 1 wherein the second liquid stream is thermally cracked at a temperature of from 399 to 538° C. and a pressure of 20 to 100 psig.

9. The process of claim 1, further comprising passing the coker gas to a recovery section of an olefin plant.

10. The process of claim 1, further comprising passing the gaseous hydroprocessed product to a recovery section of an olefin plant.

11. The process of claim 1, further comprising separating a pyrolysis fuel oil from the cracked effluent and passing the pyrolysis fuel oil to step (d).

* * * * *